US009505470B1

(12) United States Patent
Martens

(10) Patent No.: US 9,505,470 B1
(45) Date of Patent: Nov. 29, 2016

(54) SPORTS DEVICE STRUCTURES AND COMPOSITIONS

(71) Applicant: John Arthur Martens, Tucson, AZ (US)

(72) Inventor: John Arthur Martens, Tucson, AZ (US)

( * ) Notice: Subject to any disclaimer, the term of this patent is extended or adjusted under 35 U.S.C. 154(b) by 65 days.

(21) Appl. No.: 14/709,768

(22) Filed: May 12, 2015

(51) Int. Cl.
*B63B 9/06* (2006.01)
*B63B 35/79* (2006.01)

(52) U.S. Cl.
CPC ..... *B63B 35/7909* (2013.01); *B63B 9/06* (2013.01)

(58) Field of Classification Search
CPC ..... B63B 35/7909; B63B 9/06
USPC ..... 441/74
See application file for complete search history.

(56) References Cited

U.S. PATENT DOCUMENTS 6,012,734 A * 1/2000 Skedeleski ..... A63C 5/03 114/219
7,578,715 B2 * 8/2009 Wilkie ..... B63B 35/815 441/65
9,062,166 B2 * 6/2015 Zur ..... B29C 44/32

* cited by examiner

*Primary Examiner* — Lars A Olson
*Assistant Examiner* — Jovon Hayes
(74) *Attorney, Agent, or Firm* — Mark A. Litman & Associates, P.A.

(57) ABSTRACT

The present invention relates to a sports device, such as a surf board, water board, and the like for use by persons in moving over a water surface. The device generally has:

a) a central foam core;
b) a cover fabric laminated around the central foam core;
c) a laminating adhesive securing the cover fabric to the central foam core; and
d) a water resistant polymeric coating covering the laminated cover fabric and laminating adhesive.

The laminating adhesive generally has a specific gravity of less than 2.0 g/m$^3$. The laminating adhesive may have a Shore A hardness of at least 70 and may be a water-based polyurethane emulsion, a methacrylate-acrylate copolymer emulsion, an epoxy or epoxy-acrylate hybrid emulsion adhesive or a mixture of at least any two of these adhesives.

27 Claims, No Drawings

SPORTS DEVICE STRUCTURES AND COMPOSITIONS

BACKGROUND OF THE INVENTION

1. Field of the Invention

The invention relates to improved surfboard constructions and compositions.

2. Background of the Art

Normally, surfing devices having a board-like body, so-called surfboards, are provided with a foam core that is encased with a bonded laminate for strength and have an upper side and a lower side. Commonly used resins for bonding the laminate to the foam core to create strength are the unsaturated polyester resins that contain up to about 40% by weight styrene as the curing agent or 2-part epoxy resins cured with amine functional hardeners. Styrene is officially classified as a volatile organic compound (VOC) and hazardous air pollutant (HAP) and has worker safety issues from long term exposure to its vapors requiring workers to wear protective breathing equipment to protect them. While the 2-part epoxy resins do not contain styrene, they expose workers using them to safety hazards that can include painful skin irritation and the potential for sensitization leading to rashes, etc. from skin contact. Once sensitized, workers are commonly and permanently constrained from working with these materials to avoid these adverse reactions. Thus each of these two major classes of materials commonly used to manufacture surfboards have serious worker safety and environmental pollution issues that must be carefully managed through proper handling procedures including the use of personal safety equipment and air quality management in the work area and beyond. Limiting the environmental impact of styrene evaporation from the resins during the manufacturing process of surfboards is problematic in that highly specialized and expensive air handling and treatment equipment such as carbon bed absorbers are required to capture the vapors from the work environment atmosphere before release to the environment. Furthermore, the commonly used laminate bonding resins (unsaturated polyesters with styrene, and two-part epoxy resins) are rigid and brittle materials after curing with limited flexibility and energy dissipating properties as measured by dynamic impact tests such as the Gardner Impact Test (ASTM D5420-10).

Following the lamination of fiberglass (or other reinforcing fabric derived from carbon fiber, Kevlar® fiber, Vectran® fiber or other high modulus fibers), a protective coating (gel coat, hot coat) is applied and cured. The protective coating provides protection from water penetration, sunlight associated degradation, abrasion resistance, toughness and also adds stiffness to the surfboard construction. Typically (standard practice) unsaturated polyester resins containing styrene (as curing agent) or 2-part epoxy resins consisting of an epoxy functional resin—Part A—such as glycidyl ethers of Bis-Phenol A, and amine functional resin—Part B— consisting of amine (—$NH_2$) functional polyethers such as poly(propylene glycol) diamine. As previously stated, the unsaturated polyester resins contain styrene that is a Hazardous Air Pollutant (HAP), and Volatile Organic Compound (VOC) that can cause irritation to workers, and as such, is tightly regulated. Appropriate safety measures must be exercised to protect workers and the environment using this material. While the 2-part epoxy resins typically do not contain VOC's or HAP's, they nonetheless require workers to use appropriate safety measures to avoid adverse reactions to exposure such skin rashes and sensitization that can be disabling to those exposed.

Various modifications of the construction of surfboards also include alternative foam constructions such as polyurethane or n polystyrene (EPS) foams with or without a wood stringer down the middle of the board that provides additional strength. Other types of foams such as isocyanurate foams can also be used. The epoxy resins in conjunction with the glass fiber fabric are typically stronger than the unsaturated polyester based resins (containing styrene) such that the wood stringer may not be needed.

The present invention tends to provide means to produce high performance composites including but not limited to recreational water craft (surf boards, kite boards, wind surfing boards, wake boards, body boards, stand up paddle boards, etc.) with potentially safe materials and methods that: 1) eliminate VOC and HAP environmental hazards and worker safety issues in manufacture of the high performance composites by minimizing worker exposure hazards; 2) provide energy dissipating properties (while in use as components of the devices of the invention) and 3) Methods of utilizing these materials to manufacture devices of the aforementioned types, especially for surfing with a board-like body, which in comparison to conventional surfboards have a considerably longer service life, and greater impact damage resistance, by virtue of the energy dissipating properties of the potentially "safe" materials of the invention, thereby greatly reducing the danger of a board breaking, and whereby an individual adaptation to the individual surfer and their specific performance needs is possible.

The present invention tends to improve the performance of surfboards and other sports devices or craft produced as a result of the novel structure and composition of the present technology results improved performance as quantified by specific energy dissipating properties determined by specific ASTM testing procedures. The increased energy dissipation performance of the devices of the invention result in increasing durability of the devices including improved resistance to damage due to dynamic impact with objects including other surf boards while in use, stray objects in the path of the surfer in the water, including rocks, logs, coral, or other debris. Surfers may also be provided with better controllability of the surfboard under all water conditions.

SUMMARY OF THE INVENTION

The present invention relates to a sports device, such as a surf board, snow board, water board, water ski, and the like for use by persons in moving over a water surface. The device generally has:

a) a central foam core;
b) a cover fabric laminated around the central foam core;
c) a laminating adhesive securing the cover fabric to the central foam core; and
d) a water resistant polymeric coating covering the laminated cover fabric and laminating adhesive.

The laminating adhesive generally has a specific gravity of less than 2.0 grams/$cm^3$.

DETAILED DESCRIPTION OF THE INVENTION

The present invention relates to a sports device, such as a surf board, water board, and the like for use by persons in moving over a water surface. The device generally has:

a) a central foam core;
b) a cover reinforcing fabric laminated around the central foam core;
c) a laminating adhesive securing the cover fabric to the central foam core; and
d) a water resistant polymeric coating covering the laminated cover fabric and laminating adhesive.

The laminating adhesive generally has a specific gravity of less than about 2.0 grams/cm$^3$. The laminating adhesive may have a Shore A hardness of between 70 and 85, may have open or preferably closed cells within structure of the laminating adhesive. The laminating adhesive may be a water-based emulsion, such as a water-based urethane resin emulsion, polyacrylate emulsion and the like. As further described in specific descriptions of useful resins, the polyurethane adhesive may have generally relatively high proportions of isocyanate materials in its reactive mixture to provide both greater hardness and strong shear resistance. For example, the urethane resin comprises between 25-35% by number average of reacted molecular units comprising isocyanate groups.

A corresponding method of manufacturing the sports device may be:

a) shaping a foam central core;
b) wrapping a fabric cover around the shaped foam central core;
c) applying a (preferably non-solvent-based) flowable laminating adhesive composition to the wrapped fabric cover;
d) leveling the applied flowable laminating adhesive over the wrapped cover fabric surface so that the flowable adhesive is in contact with both the wrapped cover fabric and surfaces of the foam central core;
e) removing volatiles such as water from the laminating adhesive to dry the laminating adhesive and secure the cover fabric to the foam core; and
f) applying a water resistant polymeric coating over all surfaces of the laminated cover fabric and laminating adhesive;

wherein the dried laminating adhesive has a specific gravity of less than about 2.0 grams/cm$^3$.

The laminating adhesive used in the method claims is of course the same as that described above for the sports device. The method may also include using one or more sheets of overlapping fiber glass, and first one sheet is applied to a first major surface of the foam core so that sides of the foam core are covered and then a second sheet of cover fabric are applied to an opposed second major surface with ends of the second sheet of cover fabric overlapping the first cover fabric sheet on sides of the foam core before all laminating adhesive is applied and dried on the sports device. The method may be performed where the flowable laminating adhesive is formed by mixing i) an emulsion polyurethane-urea, ii) emulsion polyurethane-urea elastomer, iii) thickening agent and iv) dispersing agent. The ratio of i) to ii) may be generally in the range of 10:1 to 1:1, more preferably in the range of 8:1 to 2:1 and most preferable in the range of 7:1 to 2.5:1. The thickening agent may be present as 0.1 to 3%, or 0.2% to 2.5%, or 0.3 to 2.0% by weight of the flowable laminating adhesive and the dispersing agent is present as 0.01% to 0.5%, 0.015 to 0.4% by weight of the flowable laminating adhesive.

The method may be performed by providing a packaged kit in which the kit package contains the fabric (reinforcing fabric) cover and a preferably two-part (it may be premixed) adhesive composition of i) an emulsion polyurethane-urea, ii) emulsion polyurethane-urea elastomer, iii) thickening agent and iv) dispersing agent. The ratio of i) to ii) may be generally in the range of 10:1 to 1:1, more preferably in the range of 8:1 to 2:1 and most preferable in the range of 7:1 to 2.5:1. The thickening agent may be present as 0.1 to 3%, or 0.2% to 2.5%, or 0.3 to 2.0% by weight of the flowable laminating adhesive and the dispersing agent is present as 0.01% to 0.5%, 0.015 to 0.4% by weight of the flowable laminating adhesive. The dispersing agent and thickening agent may be accrued in either one or both of the emulsion polyurethane resin or the emulsion polyurethane elastomer composition.

The water resistant polymeric coating (gel coat or hot coat) that covers the entire external surface of the laminated structure of the device the inventive component for surf boards application is preferably a 2-part polyurethane-urea resin consisting of an oligomeric isocyanate-Part A—and an aspartic amine containing formulation—Part B— that co-reacts (cures) with Part A after mixing and application to the external surface of the surf board under construction. Part B can also contain other components such as co-polymerizable polyols (such as polyester diols or triols, polyether diols or triols, acrylic polyols) and other adjuvants such as UV absorbers, Optical Brighteners, Dyes or pigments for coloration, curing retarders, glass microbubbles (to reduce density), curing catalysts, and inorganic fillers (such as mica, silica, titanium dioxide) to modify surface gloss, transparency, or surface texture of the coating. The combination of the polyurethane-urea external coating, as described above, along with the polyurethane-urea or methacrylate-acrylate emulsion laminating materials provides an environmentally friendly end use surf board that is free of HAP's, VOC's, is convenient to produce with minimal safety concerns for the surf board builder, and yields a tough and durable surf board.

Alternatively, the polymeric coating can be a 2-part epoxy, an unsaturated polyester resin (containing styrene) or in the case of an inventive component for surf boards application, it is preferably a 2-part polyurethane-urea resin consisting of an oligomeric isocyanate—Part A—and an aspartic amine containing formulation—Part B— that that is co-reacted with Part A. Part B can also contain other ingredients such as co-polymerizable polyols (such as polyester diols or triols, polyether diols or triols, acrylic polyols) and others such as UV absorbers, Optical Brighteners, Dyes or pigments for coloration, curing retarders, glass microbubbles (to reduce density), curing catalysts, inorganic fillers (such as mica, silica, titanium dioxide) to modify surface gloss, transparency, or surface texture of the coating.

These aspects of the technology may be inventively realized by device(s), material(s) for manufacturing the devices with specific properties, and methods for its manufacture.

The inventive device for surfing or the like is provided with a board-like body that has a foam core that is encased in a laminate and an overcoating, with the board-like body having an upper side and a lower side as opposed major surfaces. The opposed major surfaces are nominally flat or with a gentle curvature extending from the front (leading) edge to the rear (trailing) edge of the desired surf board, with curvature extending to and over the edges adjacent the major surfaces. The laminating fabric(s) are bonded to the foam core using the inventive materials described in this invention. Various types and configurations of the laminating fabric can be used to produce composite structures including surf boards or other water craft including wake boards, body boards, stand-up-paddle boards or others using a similar construction, namely laminating fabric(s) bonded to a foam core using the inventive materials and methods of this invention and optionally including a finish coat (also referred to as a varnish coat, top coat, gel coat, or hot coat or other terms) that can provide additional water proofing (increased resistance from water migration into the laminated fabric/foam structure), protection from ultraviolet radiation (as from the sun), abrasion resistance (protection from scraping with hard objects such as rocks and sand), a textured surface for improved grip (as with the feet while standing on the surfboard), adhesion of graphics layers (such as decals, specialty painted logos, or eye catching colored scenes) and other features as desired.

At least the edge region of the front and/or rear longitudinal end and/or the left and/or the right side of the board-like body is provided—or possibly each or both ends (i.e. the front and rear longitudinal end and/or the right and left side is provided)—with at least two woven laminate plies, at least one of which (that is including both overlapping and extending) extends from the upper to the lower side, or vice versa, about the profile of the longitudinal end.

Due to this special configuration, when combined with the energy absorbing polymeric materials of this invention, a sports device may be provided with a balance of stiffness, resilience and elasticity that is considerably greater and better controlled than that of conventional surfboards.

Specific performance improvements targeted by this invention can be quantified with objective tests such as the Gardner Impact Test (ASTM D5420-10) which is routinely used to determine the resistance of plastic materials to deformation and breakage caused by impact with a projectile of specified dimensions and shape accelerated by the force of gravity over specific distances This test can provide detailed performance comparisons between various materials of construction, including the bonding resins used, and construction configurations of the composite with variables such as the type of foam, the thickness of the foam, the basis weight of the preferably glass reinforcing fabric (ounces/yard$^2$), the number of layers of the glass fabric utilized, the chemical type and mechanical property characteristics of the bonding resin, the resulting adhesion of the bonding resin/glass fabric to the underlying foam and the presence of an external coating (also known as gel coat, top coat, finish coat, varnish coat or "hot" coat) applied on top of the bonded fabric and its thickness and mechanical properties. Materials (bonding resins), formulations and devices possessing increased energy dissipation, characterized as having such properties using the Gardner Impact Test (ASTM D5420-10) performance results compared to those developed with the bonding resins currently being used (unsaturated polyester resins with styrene as curing agent or epoxy resins cured with amine functional curing agents) have surprisingly been achieved and will be exemplified in this application.

Increased impact resistance of the boards produced using the materials of the present invention leads to longer service life and reduced danger of board breaking from striking objects such as other surfboards in use, objects in the water in the direct line of movement of the board being ridden, submerged objects (rocks, sand bars, etc.) that can be accidently struck by the underside of the surfboard being ridden as it passes overhead or objects floating in the water.

The inventive devices defined according to the teachings of this invention may be produced using preferably emulsion polymer bonding resins (especially polymeric materials dispersed in water). Suitable emulsion polymers include, for example, those materials that are used for bonding textiles or as adhesives in various applications such as carpet bonding that are water resistant (after drying) and have bonding strength to provide at least 0.2 kilogram of adhesion per lineal centimeter of bond width (fabric to fabric or fabric to substrate). This would include materials such as the acrylonitrile-butadiene-styrene based emulsion polymers, poly (chloroprene) based emulsion polymers, styrene-methacrylate-acrylate or methacrylate-acrylate copolymer based emulsions and polyurethane, or polyurethane-urea based polymers (as emulsions) either alone or in blended formulations (as emulsions). These formulations can also incorporate curing or crosslinking agents of various types to improve bonding strength and water resistance.

Preferred emulsion polymers are those that that are essentially free of volatile organic compounds (VOC's), hazardous air pollutants (HAP's) and alkylphenol ethoxylates (APEO's) that are toxic to aquatic life and are safe for workers to use with appropriate safety equipment such as chemically resistant gloves and eye protection.

A preferred class of emulsion polymers include water dispersed polyurethanes or polyurethane-ureas produced from reaction of aliphatic isocyanates (including for example hexamethylene diisocyanate, isophorone diisocyanate and others) with selected polyols (polyester, polyether, polycarbonate or acrylic polyols containing reactive hydroxyl functionality) 1) such as those polyurethanes or polyurethane-ureas described in U.S. Pat. No. 7,972,982 and WO 2012/136521 and others that are essentially free of volatile organic compounds (VOC's), hazardous air pollutants (HAP's) and alkylphenol ethoxylates (APEO's) that are toxic to aquatic life.

A second preferred class of emulsion polymers are the methacrylate-acrylate copolymer emulsions that are likewise essentially free of volatile organic compounds (VOC's), hazardous air pollutants (HAP's) and alkylphenol ethoxylates (APEO's) that are toxic to aquatic life as described in U.S. Pat. No. 6,887,933 and U.S. Pat. No. 7,241,834 (Rohm and Haas). Advantages of the methacrylate-acrylate copolymer emulsions are their hydrophobicity (after drying), clarity, tensile strength, non-yellowing with exposure to sunlight, weatherability (stability during outdoor exposure), and the capability to vary the glass transition temperature (Tg) of the copolymers by altering the methacrylate to acrylate monomer ratios in the polymerization.

A third preferred class of emulsion polymers are the epoxy, epoxy-acrylic hybrid or epoxy-acrylate grafted polymers. These can also be self-crosslinking as they dry and harden due to water evaporation. Self-crosslinking water dispersed epoxy ester-acrylate polymers are described, for example in U.S. Pat. No. 4,212,776, while higher molecular weight epoxy emulsion polymers are described in U.S. Pat. No. 5,252,637, and aqueous dispersed epoxy-acrylate grafted polymers are described in U.S. Pat. No. 5,508,325. This class of materials also possesses excellent barrier properties to resist transportation of water and other small molecules, such as styrene that would otherwise attack the underlying foam. These barrier properties are important for protecting the porous foams utilized in the present invention from migration of water (from the sporting use environment), styrene monomer (as components of a gel or hot coat) or other components of other layers of the construction that would otherwise soften or compromise the integrity of the foam, resulting in a degradation of its' mechanical properties.

The incorporation of this class of materials either as components of the fabric bonding resins or as of a priming layer directly applied to the surface of the foam(s) before the fiberglass (or other) reinforcing fabric layer is applied can help assure the integrity of the foam through both the manufacturing process but also of the final (sporting device)

product in use in a water environment by preventing water or other deleterious molecules such as styrene from migrating to the foam.

Also, blends of these materials can be utilized to produce compositions having unique properties such as a combination of hardness and toughness (i.e. lack of brittleness) and others such as a barrier to water migration. For example, blends of two materials with widely differing glass transition temperatures (Tg) can be produced that approximate the properties of block copolymers that are not readily available in single composition formulations or as emulsions. For example, blending a water-dispersed polyurethane or polyurethane-urea composition with a methacrylate-acrylate copolymer emulsion can yield an end product composition (after water is removed by evaporation) with both hardness and toughness that maintains these properties over wide temperature ranges in use. Versatile blends with widely variable end-use properties can be produced this way by simply varying the ratios of the individual materials while retaining many of the properties of the individual components (such as non-yellowing) in the final composition. Furthermore, the individual emulsion based materials are (or may be) readily available commercially at reasonable cost facilitating the use of these materials for the purposes described in this invention.

Additionally, these materials may be cured or crosslinked using adjuvants such as hydrophilic polyisocyanates designed for this purpose by adding them to the emulsion urethane-urea materials prior to coating and drying (in use) or self-crosslinking emulsion based materials. Examples of these materials are those described in U.S. Pat. No. 5,252,696 and U.S. Pat. No. 6,767,958. These may be commercially available products described by these patents such as Bayhydur™ 302. Self-crosslinking compositions are described in for example in U.S. Pat. No. 6,512,204 and U.S. Pat. No. 4,212,776.

However, curing or crosslinking is not essential for their use in the applications described in this invention description, as after dry-down (elimination of water by evaporation) the emulsion polymers of this invention are, in general, high molecular weight materials having the requisite mechanical properties necessary to function as laminating or bonding adhesives.

The preferred emulsion polyurethanes or polyurethane-ureas, or the preferred polyacrylic emulsion polymers may be utilized either alone as bonding resins or in combination (blends) with each other such that the resulting formulations are likewise free of volatile organic compounds (VOC's), hazardous air pollutants (HAP's) and alkylphenol ethoxylates (APEO's). The preferred polyurethane or polyurethane-urea polymers are notable for their toughness (lack of brittleness) and flexibility over wide temperature ranges (such as 0 degrees Centigrade up to 100° C. and above), hydrolytic stability (as during exposure to water including sea water), abrasion resistance, ability to adhesively bond to materials such as fabrics (both woven and non-woven) made of fiberglass, various nylons (such as nylon 6,6), polyester resins (such as polyethylene terephthalate), aramid polymers (such as Kevlar) carbon or graphite fiber based fabrics, and others and foam based materials such as polyurethane based foams, expanded polystyrene based foams, and others as may be used as bonded components of the inventive devices of this invention. The emulsion based polymers of the invention are utilized as bonding resins to adhere various woven or non-woven fabrics (such as glass fabric, ceramic fabric, carbon fiber based fabric, graphite fiber fabric, or other known reinforcing strength fiber or filament materials) to each other (as in constructions that contain one or more layers of fabric) to various types of polymeric foams to produce the inventive composite constructions of the invention, which constructions have utility as surf boards, kite boards, wake boards, or other recreational products, including those for use on or in the water.

A general, non-limiting example of the aspartic amines used in the practice of the present technology includes at least the following:

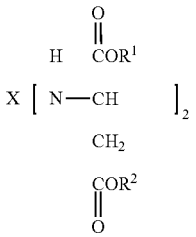

wherein X is an aliphatic group (generically including cycloaliphatic groups);

R1 and R2 are the same or different pendent groups, each of which is inert to reaction with isocyanate groups, such as alkyl (including substituted and non-substituted alkyls such as halogenated alkyls and especially fluorinated alkyls), alkoxy, and the like. The brackets are inclusive of everything in the formula except X and subscript 2. Non-limiting examples of disclosures of aspartic amines include U.S. Pat. Nos. 7,732,018; 7,682,665; 7,674,499; 7,608,303; 7,595,007; 7,595,002; 7,449,242; 7,427,647; 7,214,828 and 7,166,748.

Aliphatic polyisocyanates and other compatible or miscible polymeric materials may be blended with the aspartic amines. For example, trimers of hexamethylene diamine (including the Desmosdur® line of products (e.g., Desmodur® n-3400 additive) or isophorone diisocyanate (e.g., Desmosdur® 2489 available from Bayer Chemical).

Hardness, especially in polymeric coatings and films, is determined by industry standard values and methods.

Hardness Characterization of Conventional Surf Board Laminating Resins:

Materials:

Conventional laminating resins used to make high performance surf boards include:

I. Unsaturated Polyester resins cured with Styrene (up to 35% by weight) With free radical catalysts such as MEK peroxide (MEKP) or UV light Activated catalysts such as Irgacure® 651 (and others);
   Example: Silmar® 249A with optical brightener
II. Two part epoxy resins (Part A) that cure with amine curing agents (Part B).
   Example: Resin Research 2000CE (low viscosity resin)

Hardness testing of polymeric materials can be accomplished according to ASTM D 2240 using various durometer scales (Types A, B, C, D, DO, E, M, O, OO, OOO, OOO-S, and R). Instruments developed for this purpose include the Shore A, and Shore D hardness testers that are readily available commercially. The preferred materials of this invention have been characterized using the Shore A hardness scale and are in the range of 70 up to about 100. The Shore D hardness scale is used for materials that are harder than those characterizable using the Shore A hardness scale. Both scales cover the range from 0 to 100 but overlap (are ~equivalent) at around a Shore A hardness of 100 being approximately equal to a hardness of 60 on the Shore D scale.

Methods:

Cured samples ⅛" thick (0.125", 3.2 mm) of each of these conventionally used laminating resin products were prepared by casting into a mold, using recommended procedures and allowed to fully cure (24 hours) at room temperature. Following the cure, the samples were removed from the mold and tested using a Shore D hardness Tester (Phase II Model PHT-980).

Results:

Shore D testing of the two materials (I. and II. Above) was accomplished with the following results:

| Material | Shore D Hardness |
|---|---|
| Unsaturated Polyester (Silmar 249A) | 60 +/− 2 |
| Two Part Epoxy (Resin Research 2000 CE) | 85 +/− 3 |

Durometer hardness is also well-established in the industry and identified and defined according to American Society of Testing Materials (ASTM) designation Designation: D 2240-05: Standard Test Method for Rubber Property Durometer Hardness. This standard is incorporated herein by reference.

The following illustrative examples will demonstrate the use of a preferred polyurethane-urea emulsion based polymer formulation in the construction of a high performance surf board (also referred to as a "short board" of the type used by professional surfers in competitive events). These examples should be not be viewed as limiting in any way of the possible use of the other types of emulsion polymers described in the specification, including the methacrylate-acrylate types of preferred emulsion polymers.

Illustrative Example #1 Surf Board

This example will demonstrate and exemplify the manufacture of a high performance surf board, of a type currently in use by experienced and highly skilled individuals in competitive surfing events worldwide. The surf board described is designed for use by a surfer who weighs in the range of 150-165 pounds with the appropriate displacement volume to ensure floatation with the surfer riding on top of the board in salt water.

Materials and Procedures utilized will be described individually:

1) Bonding Fabric—(2) pieces of 4.0 ounce per square yard fiberglass fabric (24" in width and 76" in length)—(One for the "top" of the surf board, the other for the "bottom" of the surf board)

2) Polyurethane foam blank (source US Blanks) with center stringer (balsa wood) shaped by an experienced foam shaper to a competitive shape-length=72", including the female attachment elements for the metal steering fins which were pre-bonded into the appropriate cavities in the foam using a conventional 2-part epoxy resin (with hardener)

3) Fabric Bonding Resin (laminating resin) Formulation:

The following materials were blended with a laboratory mixer:

4000 grams of Dispercoll™ U8755 (emulsion polyurethane-urea from Bayer Materials Science)

1500 grams of Dispercoll™ U 42 (emulsion polyurethane-urea elastomer from Bayer Materials Science)

60 grams of Hymod™ SB432 (aluminum trihydrate) from JM Huber, a thickening agent 6.0 grams of BYK-W980 (BYK) dispersing agent A 0.125" thick and fully dried out (water removed) sample of this formulation has a Shore A hardness of 85+/−2.

Procedures:

The Dispercoll™ resins were added with mixing (using a helical mixing blade) to a clean 2-gallon wide mouth plastic pail followed by the BYK dispersing agent; After 5 minutes of mixing, the Hymod™ SB432 aluminum trihydrate was added slowly (into the vortex created by the mixing blade) to avoid clumping; Agitation was continued for 30 minutes to ensure complete and uniform consistency of the composition A commercial bag paint filter was then utilized to filter the composition into another clean 2-gallon plastic pail to remove any clumps or agglomerated materials that would otherwise interfere with the fabric bonding process After filtration, the formulation was ready for use in the fabric bonding process.

4) Bonding of Fiberglass Fabric to the Foam

A. The shaped polyurethane foam blank was positioned on a work station that balances it at ~chest height for the bonding process with mechanical supports positioned under the foam B. The pre-cut fiberglass fabric was positioned over the shaped foam so as to leave ~2" of draped fabric around the entire perimeter of the Blank (i.e., ~2" (5.08 cm) of fiberglass extends below the supported blank on all sides C. A portion (~300 grams) of the emulsion bonding formulation [from 3 above] was poured into a small plastic pan commonly used for latex paints.

D. A 6" (15.24 cm) paint roller with a foam roller element was used to apply the latex formulation to the fiberglass fabric laying on top of the shaped polyurethane foam surf board blank.

E. The roller was used to uniformly distribute the latex bonding formulation to the entire surface of the draped fiberglass fabric including the overhanging edges extending beyond and below the edges of the foam blank and to eliminate any air bubbles under the fabric (between the fabric and the polyurethane foam blank)

F. The pre-wetted (with the latex bonding formulation) overhanging fiberglass fabric was then carefully pressed against the underside (a lower major surface) of the foam blank using slight pressure from the paint roller so as to eliminate any air bubbles and ensure a uniform and consistent bond to the foam blank (after drying)

G. The latex coated and bonded construction (one side only of the foam blank) was allowed to air dry (at room temperature) for about 20 minutes (allowing moisture to evaporate) until the exposed surface was virtually "tack free"

H. The foam blank was inverted (exposing the uncoated side) and the 2nd piece of pre-cut fiberglass was draped over the uncoated side (the top major surface) of the foam blank and positioned so as to ensure a uniform drape of fabric around the perimeter of the blank (~2" on all sides)

I. Steps "C" through "G" (from above) were repeated to complete the fabric bonding process.

Note: The next steps in producing the surf board are included in this example to complete the surf board for use and demonstrate utility (in surfing) of the inventive aspects of the materials, methods, and devices of this invention J. The bonded "fabric to foam" construction (described above in steps "A" through "I") was hand sanded using 120 grit. (Grit size refers to the number of holes per square inch in the wire mesh used to fractionate the sand used to make the sandpaper) sand-paper to remove any imperfections (such as loose fibers from the fiberglass)

K. A conventional fiberglass "hot coat" (e.g., gel coat, varnish, etc.) containing styrene monomer and unsaturated polyester resins (Sylmar™ 349) was catalyzed with methyl ethyl ketone peroxide (MEKP) catalyst and then uniformly applied using a plastic "squeegee" to both the top and bottom of the fiberglass fabric bonded foam construction (Steps A through J above) and allowed to cure (at room temperature) overnight L. After the "hot coat" was fully cured, the surface of the "surf board" was lightly sanded starting with 100 grit sandpaper, followed by 220 grit sandpaper and finally with 300 grit sandpaper to yield a smooth and virtually defect free surf board.

M. After attaching the steering fins (by inserting them into the metal female fin attachment elements bonded into the foam—see Step 2) the surf board is ready for testing and use in surfing Illustrative Example #2 Surf Board This example will demonstrate and exemplify the incorporation of a crosslinking agent to the polyurethane-urea emulsion surf board, of a type currently in use by experienced and highly skilled individuals in competitive surfing events worldwide. The surf board described is designed for use by a surfer who weighs in the range of 150-165 pounds with the appropriate displacement volume to ensure floatation with the surfer riding on top of the board in salt water.

Materials and Procedures utilized will be described individually:

1) Bonding Fabric—(2) pieces of (4) ounce per square yard fiber glass fabric (24" in width and 76" in length)—(One for the "top" of the surf board, the other for the "bottom" of the surf board)

2) Polyurethane foam blank (source US Blanks) with center stringer (balsa wood) shaped by an experienced foam shaper to a competitive shape-length=72", including the female attachment elements for the metal steering fins which were pre-bonded into the appropriate cavities in the foam using a conventional 2-part epoxy resin (with hardener)

3) Fabric Bonding Resin Formulation:

The following materials were blended with a laboratory mixer:

4000 grams of Bayhydrol™ UH 2558 (emulsion polyurethane-urea from Bayer Materials Science)

60 grams of Hymod™ SB432 (aluminum tri-hydrate) from JM Huber-thickening agent

A 0.125" thick and fully dried out (water removed) sample of this formulation has a Shore A hardness of 90+/−2.

Procedures:

The Bayhydrol™ resins was added with mixing (using a helical mixing blade) to a clean 2-gallon wide mouth plastic pail followed by the BYK dispersing agent; After 5 minutes of mixing, the Hymod™ SB432 aluminum trihydrate was added slowly (into the vortex created by the mixing blade) to avoid clumping; Agitation was continued for 30 minutes to ensure complete and uniform consistency of the composition A commercial bag paint filter was then utilized to filter the composition into another clean 2-gallon plastic pail to remove any clumps or agglomerated materials that would otherwise interfere with the fabric bonding process After filtration, the formulation was stored briefly for later use in the fabric bonding process.

4) 700 grams of the Bayhydrol™ UH 2558 resin (containing the Hymod™ SB432 filler) were weighed into a (1) quart plastic mixing cup and then 56 grams of Bayhydur™ XP 2547 polyisocyanate crosslinker was added with gentle mixing.

5) Bonding of Fiberglass Fabric to the Foam

A. The shaped polyurethane foam blank was positioned on a work station that balances it at ~chest height for the bonding process with mechanical supports positioned under the foam B. The pre-cut fiberglass fabric was positioned over the shaped foam so as to leave ~2" of draped fabric around the entire perimeter of the Blank (i.e., ~2" (5.08 cm) of fiberglass extends below the supported blank on all sides C. A portion (~300 grams) of the emulsion bonding formulation [from 4 above] was poured into a small plastic pan commonly used for latex paints.

D. A 6" paint roller with a foam roller element was used to apply the latex formulation to the fiberglass fabric lying on top of the shaped polyurethane foam surf board blank.

E. The roller was used to uniformly distribute the latex bonding formulation to the entire surface of the draped fiberglass fabric including the overhanging edges extending beyond and below the edges of the foam blank and to eliminate any air bubbles under the fabric (between the fabric and the polyurethane foam blank)

F. The pre-wetted (with the latex bonding formulation) overhanging fiberglass fabric was then carefully pressed against the underside of the foam blank using slight pressure from the paint roller so as to eliminate any air bubbles and ensure a uniform and consistent bond to the foam blank (after drying)

G. The latex coated and bonded construction (one side only of the foam blank) was allowed to air dry (at room temperature) for about 20 minutes (allowing moisture to evaporate) until the exposed surface was virtually "tack free"

H. The foam blank was inverted (exposing the uncoated side) and the 2nd piece of pre-cut fiberglass was draped over the uncoated side of the foam blank and positioned so as to ensure a uniform drape of fabric around the perimeter of the blank (~2" on all sides)

I. Steps "C" through "G" (from above) were repeated to complete the fabric bonding process.

Note: The next steps in producing the surf boards are included in this example to complete the surf board for use and demonstrate utility (in surfing) of the inventive aspects of the materials, methods, and devices of this invention J. The bonded "fabric to foam" construction (described above in steps "A" through "I") was hand sanded using 120 grit sand-paper to remove any imperfections (such as loose fibers from the fiberglass)

K. A conventional 2-part epoxy "hot coat" (aka gel coat, varnish, etc.) consisting of a epoxy oligomer (Part A) and a polyether amine curing agent (Part B) was uniformly applied using a plastic "squeegee" to both the top and bottom of the fiberglass fabric bonded foam construction (Steps A through J above) and allowed to cure (at room temperature) overnight L. After the "hot coat" was fully cured, the surface of the "surf board" was lightly sanded starting with 100 grit sandpaper, followed by 220 grit sandpaper and finally with 300 grit sandpaper to yield a smooth and virtually defect free surf board.

M. After attaching the steering fins (by inserting them into the metal female fin attachment elements bonded into the foam—see Step 2) the surf board is ready for testing and use in surfing Illustrative Example #3 Surf Board This example will demonstrate and exemplify the use of a polymethacrylate-acrylate emulsion polymer formulation to bond fiberglass to an EPS (expanded polystyrene foam surf board blank) to produce a type of board useful for general purpose surfing including wind surfing. The surf board described is designed for use by a surfer who weighs in the range of 150-165 pounds with the appropriate displacement volume to ensure floatation with the surfer riding on top of the board in salt water.

Materials and Procedures utilized will be described individually:

1) Bonding Fabric—(2) pieces of (4) ounce per square yard fiber glass fabric (24" in width and 76" in length)—(One for the "top" of the surf board, the other for the "bottom" of the surf board)

2) EPS (expanded polystyrene) foam blank (generic source)

3) Fabric Bonding Resin Formulation:

The following materials were blended with a laboratory mixer:

2750 grams of Plextol™ 5530 (emulsion methacrylate-acrylate copolymer from Synthomer Chemical Co.)

250 grams of Plextol™ 5511 (emulsion acrylate copolymer from Synthomer Chemical Co.)

5 grams of Rohagit™ SD-15 (emulsion methacrylate-acrylate copolymer from Synthomer Chemical Co.)—a polymethacrylate-acrylate thickening agent.

A 0.125" thick and fully dried out (water removed) sample of this formulation has a Shore A hardness of 80+/−2.

Procedures:

The Plextol™ resins was added with mixing (using a helical mixing blade) to a clean 2-gallon wide mouth plastic pail; After 10 minutes of mixing, the Rohagit™ SD-15 resin was added slowly (into the vortex created by the mixing blade); Rohagit™ SD-15 acts as a "thickener" and increases the viscosity of the emulsion mixture to improve handling in use (reducing the tendency for the emulsion mixture to "run off" (by flow) from the surface of the reinforcing fabric on foam. Agitation was continued for another 10 minutes to ensure complete and uniform consistency of the composition.

A commercial bag paint filter was then utilized to filter the composition into another clean 2-gallon plastic pail to remove any clumps or agglomerated materials that would otherwise interfere with the fabric bonding process After filtration, the formulation was stored briefly for later use in the fabric bonding process.

4) 600 grams of the methacrylate-acrylate blended resins (containing the Rohagit™ SD-15 thickener) were weighed into a (1) quart plastic mixing cup in preparation for the fabric bonding step.

5) Bonding of Fiberglass Fabric to the Foam

A. The shaped EPS foam blank was positioned on a work station that balances it at ~chest height for the bonding process with mechanical supports positioned under the foam B. The pre-cut fiberglass fabric was positioned over the shaped foam so as to leave ~2" of draped fabric around the entire perimeter of the Blank (i.e., ~2-inch (5.08 cm) of fiberglass extends below the supported blank on all sides C. A portion (~300 grams) of the emulsion bonding formulation (from 4 above) was poured into a small plastic pan commonly used for latex paints.

D. A 5-inch plastic squeegee was used to apply the latex formulation to the fiberglass fabric lying on top of the shaped EPS foam surf board blank.

E. The squeegee was used to uniformly distribute the latex bonding formulation to the entire surface of the draped fiberglass fabric including the overhanging edges extending beyond and below the edges of the foam blank and to eliminate any air bubbles under the fabric (between the fabric and the EPS foam blank)

F. The pre-wetted (with the latex bonding formulation) overhanging fiberglass fabric was then carefully pressed against the underside of the foam blank using slight pressure from the paint roller so as to eliminate any air bubbles and ensure a uniform and consistent bond to the foam blank (after drying)

G. The latex coated and bonded construction (one side only of the foam blank) was allowed to air dry (at room temperature) for about 30 minutes (allowing moisture to evaporate) until the exposed surface was virtually "tack free"

H. The foam blank was inverted (exposing the uncoated side) and the 2nd piece of pre-cut fiberglass was draped over the uncoated side of the foam blank and positioned so as to ensure a uniform drape of fabric around the perimeter of the blank (~2 inch on all sides)

I. Steps "C" through "G" (from above) were repeated to complete the fabric bonding process.

Note: The next steps in producing the surf boards are included in this example to complete the surf board for use and demonstrate utility (in surfing) of the inventive aspects of the materials, methods, and devices of this invention J. The bonded "fabric to foam" construction (described above in steps "A" through "I") was hand sanded using 120 grit sand-paper to remove any imperfections (such as loose fibers from the fiberglass)

K. A conventional 2-part epoxy "hot coat" (aka gel coat, varnish, etc.) consisting of a epoxy oligomer (Part A) and a polyether amine curing agent (Part B) was uniformly applied using a plastic "squeegee" to both the top and bottom of the fiberglass fabric bonded foam construction (Steps A through J above) and allowed to cure (at room temperature) overnight L. After the "hot coat" was fully cured, the surface of the "surf board" was lightly sanded starting with 100 grit sandpaper, followed by 220 grit sandpaper and finally with 300 grit sandpaper to yield a smooth and virtually defect free surf board.

M. After attaching the steering fins (by inserting them into the metal female fin attachment elements bonded into the foam—see Step 2) the surf board is ready for testing and use in surfing.

Illustrative Example #4 Mini-Surf Board

This example demonstrates and exemplifies the use of a blend of a methacrylate-acrylate emulsion formulation with a polyurethane-urea emulsion formulation to bond fiberglass to an EPS (expanded polystyrene foam) to produce a miniature surf board useful for general purpose testing of product constructions. The miniature surf board described is primarily designed to evaluate construction materials and methods for potential suitability to produce full-sized surf boards but which are practical for use in a laboratory setting without need for testing in actual surfing operations.

Materials and Procedures utilized will be described individually:

1) Bonding Fabric—(2) pieces of (4) ounce per square yard fiber glass fabric (8 inches in width and 16 inches in length)—(One for the "top" of the surf board, the other for the "bottom" of the mini-surf board);
2) EPS (expanded polystyrene) foam blank (source home-made from 1" polystyrene insulating foam purchased at Home Depot) in an oval shape approximately 6" wide, 14" in length and 1" in thickness with rounded edges having a radius of approximately 0.5" to simulate the "rails" of a full sized surf board;
3) Fabric Bonding Resin Formulation (as described below).
4) The following materials were blended with a laboratory mixer:
   100 grams of Plextol™5530 (emulsion methacrylate-acrylate copolymer from Synthomer Chemical Co.)
   300 grams of Bayhydrol™ UH 2558 (emulsion polyurethane-urea copolymer from Bayer Chemical Co.)
   2.0 grams of Rohagit™ SD-15 (emulsion methacrylate-acrylate copolymer from Synthomer Chemical Co.)—a polymethacrylate-acrylate thickening agent A 0.125" thick and fully dried out (water removed) sample of this formulation has a Shore A hardness of 92+/−2.

Procedures:

The Plextol™ and Bayhydrol™ resins was added with mixing (using a helical mixing blade) to a clean 1-quart wide mouth plastic mixing cup; After 10 minutes of mixing, the Rohagit™ SD-15 resin was added slowly (into the vortex created by the mixing blade); Rohagit™ SD-15 acts as a "thickener" and increases the viscosity of the emulsion mixture to improve handling in use (reducing the tendency for the emulsion mixture to "run off" (by flow) from the surface of the reinforcing fabric on foam. Agitation was continued for another 10 minutes to ensure complete and uniform consistency of the composition.

A commercial bag paint filter was then utilized to filter the composition into another clean 1-quart (1.08 L) plastic mixing cup to remove any clumps or agglomerated materials that would otherwise interfere with the fabric bonding process After filtration, the formulation was stored briefly for later use in the fabric bonding process.

4) 200 grams of the blended polyurethane-urea and methacrylic-acrylic emulsion mixture was weighed into a (1) quart plastic cup.

5) Bonding of Fiberglass Fabric to the Foam

A. The shaped EPS foam mini-blank was positioned on a work station ~chest height for the bonding process with mechanical support positioned under the foam
B. The pre-cut fiberglass fabric was positioned over the shaped foam so as to leave ~1 inch of draped fabric around the entire perimeter of the Blank (i.e., ~1 inch (2.54 cm) of fiberglass extends below the supported blank on all sides
C. A portion (~100 grams) of the emulsion bonding formulation (from 4) above) was poured into a small plastic pan commonly used for latex paints.
D. A 2 inch wide paint brush was used to apply the latex formulation to the fiberglass fabric lying on top of the shaped EPS foam mini-surf board blank.
E. The paint brush was used to uniformly distribute the latex bonding formulation to the entire surface of the draped fiberglass fabric including the overhanging edges extending beyond and below the edges of the foam blank and to eliminate any air bubbles under the fabric (between the fabric and the polyurethane foam blank)

F. The pre-wetted (with the latex bonding formulation) overhanging fiberglass fabric was then carefully pressed against the underside of the foam blank using slight pressure from the paint roller so as to eliminate any air bubbles and ensure a uniform and consistent bond to the foam blank (after drying)

G. The latex coated and bonded construction (one side only of the foam blank) was allowed to air dry (at room temperature) for about 20 minutes (allowing moisture to evaporate) until the exposed surface was virtually "tack free"
H. The foam mini-blank was inverted (exposing the uncoated side) and the 2nd piece of pre-cut fiberglass was draped over the uncoated side of the foam blank and positioned so as to ensure a uniform drape of fabric around the perimeter of the blank (~2" on all sides)
I. Steps "C" through "G" (from above) were repeated to complete the fabric bonding process.

Note: The next steps in producing the surf boards are included in this example to complete the surf board for use and demonstrate utility (in surfing) of the inventive aspects of the materials, methods, and devices of this invention J. The bonded "fabric to foam" construction (described above in steps "A" through "I") was hand sanded using 120 grit sand-paper to remove any imperfections (such as loose fibers from the fiberglass)
K. A conventional 2-part epoxy "hot coat" (aka gel coat, varnish, etc.) consisting of a epoxy oligomer (Part A) and a polyether amine curing agent (Part B) was uniformly applied using a plastic "squeegee" to both the top and bottom of the fiberglass fabric bonded foam construction (Steps A through J above) and allowed to cure (at room temperature) overnight
L. After the "hot coat" was fully cured, the surface of the "surf board" was lightly sanded starting with 100 grit sandpaper, followed by 220 grit sandpaper and finally with 300 grit sandpaper to yield a smooth and virtually defect free mini-surf board.
M. This example is illustrative of the materials and processes that could be used to produce a full-sized surf board suitable for surfing by experienced surfers. The small scale mini-surf board produced in this example is useful to evaluate the materials and processes for manufacture in small scale to conserve raw materials and with reduced labor.

Illustrative Example #5

Protective Epoxy Based Primer for Surf Board Foam

This example will demonstrate and exemplify the use of a blended emulsion formulation containing an epoxy-acrylate hybrid polymer and a polyurethane-urea emulsion as a primer to protect the foam (EPS—expanded polystyrene foam or other) used to make surf boards from water migration or migration (to the foam) of other materials that would otherwise attack the foam reducing its strength and integrity.

The miniature surf board blank described in this example is identical to that described in Example 4 (above).

Materials and Procedures Utilized Will be Described Individually:

1) EPS (expanded polystyrene) foam blank (source homemade from 1-inch polystyrene insulating foam purchased at Home Depot) in an oval shape approximately 6 inches wide, 14 inches in length and 1 inch in thickness with rounded edges having a radius of approximately 0.5 inches to simulate the "rails" of a full sized surf board;

2) Primer Composition:

The following materials were blended with a laboratory mixer:

500 grams of Bayhydrol™ UH 2558 (emulsion polyurethane-urea copolymer from Bayer Chemical Co.)

500 grams of epoxy-acrylate hybrid copolymer emulsion (obtained from the Kilz Corporation)

A 0.125" thick and fully dried out (water removed) sample of this formulation has a Shore A hardness of 78+/−2.

Procedures:

A. The Bayhydrol™ UH 2558 and epoxy-acrylate emulsion resins were added with mixing (using a helical mixing blade) to a clean ½-gallon wide mouth plastic mixing cup; Agitation was continued for 20 minutes to ensure complete and uniform consistency of the composition.

B. A commercial bag paint filter was then utilized to filter the composition into another clean ½ gallon plastic mixing cup to remove any clumps or agglomerated materials that would otherwise interfere with the fabric bonding process C. After filtration, the final formulation was repackaged into (1) quart plastic bottles (with caps) for storage and use.

D. Application of the Primer to the Foam:

The EPS (expanded polystyrene) foam mini-blank (~1-inch×6-inch×14-ich) was coated with the priming composition on all surfaces and allowed to air dry completely. A $2^{nd}$ primer coating was then applied and then likewise allowed to air dry completely.

E. Water Soak Testing:

5 gallons (26.6 L) of tap water containing 1 lb. (454 g) of table salt (to simulate sea water) was prepared for use in the test. The epoxy-acrylate containing primer coated mini-foam blank was pre-weighed using a digital scale to determine its base weight. Next the primer coated mini-foam blank was immersed in the salt/water mixture and allowed to remain immersed for 1 month while being periodically removed, dried to the touch with a soft towel and re-weighed to determine the weight gain (if any) from water migrating into the foam. A control foam blank (without the primer) was likewise weighed, immersed and re-weighed periodically to compare it to the blank that was protected with the epoxy primer. The data from this study is contained in Table 1 (below).

TABLE 1

Epoxy-acrylate/Polyurethane-urea Primer/Sealer on expanded polystyrene foam

| Soak Time in Salt Water (Days) | CONTROL FOAM Weight Grams (% Wt. Gain) | Epoxy-urethane Primed FOAM Grams (% Wt. Gain) |
|---|---|---|
| 0 | 18.8 (0) | 38.0 (0) |
| 7 | 20.3 (8.0) | 38.0 (0.0) |
| 23 | 20.8 (10.6) | 38.0 (0.0) |
| 35 | 21.0 (11.7) | 37.4 (−1.6) |
| 50 | 21.4 (13.8) | 38.0 (0.0) |

As noted from the table, the foam blank protected with the epoxy primer gained virtually no additional weight from the salt/water immersion throughout the period of the test, while the unprotected (no primer) foam blank gained over 13% by weight (of water). It was likewise noted that the unprotected foam blank became soft and pliable during immersion in salt/water, while the primer protected foam blank did not.

Illustrative Example #6

Surf Board with Polyaspartic Amine Cured External Coating

This example will demonstrate and exemplify the inclusion of a polyaspartic amine-cured external coating (gel coat, hot coat) added to a polyurethane-urea emulsion laminated surf board.

Materials and Procedures utilized will be described individually:

1) Bonding Fabric—(2) pieces of (4) ounce per square yard fiber glass fabric (24 inches in width and 76 inches in length)—(One for the "top" of the surf board, the other for the "bottom" of the surf board)

2) Polyurethane foam blank (source US Blanks) with center stringer (balsa wood) shaped by an experienced foam shaper to a competitive shape-length=72", including the female attachment elements for the metal steering fins which were pre-bonded into the appropriate cavities in the foam using a conventional 2-part epoxy resin (with hardener)

3) Fabric Bonding Resin Formulation:

The following materials were blended with a laboratory mixer:

2000 grams of Bayhydrol™ UH 2558 (emulsion polyurethane-urea from Bayer Materials Science)

10 grams of Rohagit™ SD-15-thickening agent

A 0.125" thick and fully dried out (water removed) sample of this formulation has a Shore A hardness of 90+/−2.

Procedures:

The Bayhydrol™ resin was added with mixing (using a helical mixing blade) to a clean 1-gallon wide mouth plastic pail; After 5 minutes of mixing, the Rohagit™ SD-15 thickening agent was added slowly (into the vortex created by the mixing blade); Agitation was continued for 20 minutes to ensure complete and uniform consistency of the composition A commercial bag paint filter was then utilized to filter the composition into another clean 1-gallon plastic pail to remove any clumps or particulates that would otherwise interfere with the fabric bonding process After filtration, the formulation was stored briefly for later use in the fabric bonding process.

4) 700 grams of the Bayhydrol™ UH 2558 resin (containing Rohagit™ SD-15 thickener) were weighed into a (1) quart plastic mixing 5) Bonding of Fiberglass Fabric to the Foam A. The shaped polyurethane foam blank was positioned on a work station that balances it at ~chest height for the bonding process with mechanical supports positioned under the foam B. The pre-cut fiberglass fabric was positioned over the shaped foam so as to leave ~2" of draped fabric around the entire perimeter of the Blank (i.e., ~2-inch (5.08 cm) of fiberglass extends below the supported blank on all sides C. A portion (~300 grams) of the emulsion bonding formulation (from 4 above) was poured into a small plastic pan commonly used for latex paints.

D. A 5-icnh plastic squeegee was used to evenly spread the latex formulation over the fiberglass fabric laying on top of the shaped polyurethane foam surf board blank.

E. The squeegee was used to uniformly distribute the latex bonding formulation to the entire surface of the draped fiberglass fabric including the overhanging edges extending beyond and below the edges of the foam blank and to eliminate any air bubbles under the fabric (between the fabric and the polyurethane foam blank)

F. The pre-wetted (with the latex bonding formulation) overhanging fiberglass fabric was then carefully pressed against the underside of the foam blank using slight pressure from the paint roller so as to eliminate any air bubbles and ensure a uniform and consistent bond to the foam blank (after drying)

G. The latex coated and bonded construction (one side only of the foam blank) was allowed to air dry (at room temperature) for about 20 minutes (allowing moisture to evaporate) until the exposed surface was virtually "tack free"

H. The foam blank was inverted (exposing the uncoated side) and the 2nd piece of pre-cut fiberglass was draped over the uncoated side of the foam blank and positioned so as to ensure a uniform drape of fabric around the perimeter of the blank (~2 inches on all sides).

I. Steps "C" through "G" (from above) were repeated to complete the fabric bonding process.

Note: The next steps in producing the surf boards are not inventive per se but rather are included in this example to complete the surf board for use and demonstrate utility (in surfing) of the inventive aspects of the materials, methods, and devices of this invention J. The bonded "fabric to foam" construction (described above in steps "A" through "I") was hand sanded using 120 grit sand-paper to remove any imperfections (such as loose fibers from the fiberglass)

K. Masking tape was carefully applied around the perimeter of the surf board at the mid-point of the "edge rails" (to provide a clean edge for the hot coat that will be applied in the next steps).

L. The hot coat formulation was prepared as follows:

1) Part A: NX-16 oligomeric aliphatic isocyanate (Pflaumer Corporation) was used unmodified;

2) Part B: 825 grams of Teraspartic-277, an aspartic amine oligomer from Pflaumer Brothers Corporation, was combined with 175 grams of Eternacoll PH-100, an ~1000 molecular weight polycarbonate diol from UBE America, Inc. in a 2-gallon mixing tank using a laboratory mixer.

3) 120 grams of Part B was weighed into a plastic weighing cup, followed by addition of 90 grams of Part A (NX-16). The ratio of Part A to Part B was calculated to provide a slight excess (1-3%) of isocyanate moieties compared to the combined amine and hydroxyl moieties in the formulation. The two components were gently mixed using a wooden tongue depressor.

4) The Part A+Part B mixture was poured quickly over the surface of the laminated surf board (J/K) from above) under construction and the mixture was uniformly distributed over the surface using a clean 5-inch plastic squeegee and allowed to cure at room temperature.

M. After the "hot coat" was fully cured (about 2 hours minimum), the surface of the "surf board" was lightly sanded starting with 100 grit sandpaper, followed by 220 grit sandpaper and finally with 300 grit sandpaper to yield a smooth and virtually defect free surf board.

N. After attaching the steering fins (by inserting them into the metal female fin attachment elements bonded into the foam—see Step 2) the surf board is ready for testing and use in surfing.

Performance Testing of the Surfboards:

The surf board #1 produced above using the materials, and methods of the present invention were tested by a former professional surfer (Bill Johnson—a member of the 1984 US National Surfing team and ranked as high as #8 in the world during his career as a professional surfer- and owner of Teqoph™ Surf Boards, Oceanside, Calif.). Bill has evaluated the performance of the board in many surfing sessions near Oceanside, Calif. over the period from ~May 20th to June 21st (2014) with excellent results. He has commented that this is the most "responsive" surf board he has ever ridden as the board has the capability of changing its shape ("flex pattern") slightly while in use by simply shifting the position of his feet and body extension resulting in weight distribution changes on the board as a result. This property of the board improves the capabilities of the rider to "steer" the board, particularly at the top of the wave to increase the rider's surfing performance and experience during the run. Bill Johnson has built many boards for the top surfers in the world including.

Surf Board #2 (described in Example #2) was likewise tested by Bill Johnson with favorable results over the period from September $10^{th}$ to Oct. 3, 2014.

Surf Board #3 (described in Example #3) was built and tested by Joe Johnson of Coco Beach, Fla.—an experienced surf board builder and surfer with many years of experience in both—with very favorable results over the period from January $15^{th}$ to Mar. 15, 2015. The board continues to perform suitably without flaws.

What is claimed:

1. A sports device for use by persons in moving over a water surface comprising:

a) a central foam core;

b) at least one layer of a cover fabric laminated around the central foam core;

c) a laminating adhesive securing the cover fabric to the central foam core; and d) a water resistant polymeric coating covering the laminated cover fabric and laminating adhesive;

wherein the laminating adhesive comprises a water-based emulsion laminating adhesive having a specific gravity of less than 2.0 $g/m^3$.

2. The sports device of claim 1 wherein the laminating adhesive has a Shore A hardness of at least 70.

3. The sports device of claim 1 wherein the laminating adhesive comprises closed cells within structure of the laminating adhesive.

4. The sports device of claim 1 wherein the laminating adhesive comprises a water-based polyurethane-urea emulsion.

5. The sports device of claim 4 wherein the water-based emulsion comprises a water-based methacrylic acid based polymer.

6. The sports device of claim 4 wherein the laminating adhesive has a Shore A hardness of between 70 and 100.

7. The sports device of claim 5 wherein the laminating adhesive has a Shore A hardness of between 70 and 100.

8. The sports device of claim 5 wherein the urethane resin comprises between 25-35% by number average of reacted molecular units comprising isocyanate groups.

9. The sports device of claim 6 wherein the urethane resin comprises between 25-35% by number average of reacted molecular units comprising isocyanate groups.

10. The sports device of claim 1 comprising a surfboard.

11. The sports device of claim 5 comprising a surfboard.

12. The sports device of claim 10 wherein the at least one cover fabric comprise fiber glass.

13. A method of manufacturing a sports device comprising:

a) shaping a foam central core;

b) wrapping a fabric cover around the shaped foam central core;

c) applying a water-based flowable laminating adhesive composition to the wrapped fabric cover;

d) leveling the applied flowable laminating adhesive over the wrapped cover fabric surface so that the flowable adhesive is in contact with both the wrapped cover fabric and surfaces of the foam central core;

e) removing water from the laminating adhesive to dry the laminating adhesive and secure the cover fabric to the foam core; and 0 applying and drying a water resistant polymeric coating over all surfaces of the laminated cover fabric and laminating adhesive;

wherein the dried laminating adhesive has a specific gravity of less than 2.0 g/m$^3$.

14. The method of claim 13 wherein the dried laminating adhesive has a Shore A hardness of at least 70.

15. The method of claim 13 wherein the laminating adhesive comprises closed cells within structure of the dried laminating adhesive.

16. The method of claim 13 wherein the laminating adhesive comprises a water-based emulsion.

17. The method of claim 16 wherein the water-based emulsion comprises a water-based urethane resin.

18. The method of claim 16 wherein the dried laminating adhesive has a Shore A hardness of between 70 and 100.

19. The method of claim 17 wherein the laminating adhesive has a Shore A hardness of between 70 and 100.

20. The method of claim 17 wherein the urethane resin comprises between 25-35% by number average of reacted molecular units comprising isocyanate groups.

21. The method of claim 18 wherein the urethane resin comprises between 25-35% by number average of reacted molecular units comprising isocyanate groups.

22. The method of claim 13 wherein the cover fabric comprises two sheets of overlapping fiber glass, and first one sheet is applied to a first major surface of the foam core so that sides of the foam core are covered and then a second sheet of cover fabric are applied to an opposed second major surface with ends of the second sheet of cover fabric overlapping the first cover fabric sheet on sides of the foam core before all laminating adhesive is applied and dried on the sports device.

23. The method of claim 13 wherein the flowable laminating adhesive is formed by mixing i) an emulsion polyurethane-urea, ii) emulsion polyurethane-urea elastomer, iii) thickening agent and iv) dispersing agent.

24. The method of claim 23 wherein the ration of i) to ii) is in the range of 8:1 to 2:1.

25. The method of claim 24 wherein the thickening agent is present as 0.2 to 2% by weight of the flowable laminating adhesive and the dispersing agent is present as 0.01% to 0.5% by weight of the flowable laminating adhesive.

26. A sports device for use by persons in moving over a water surface comprising:

a) a central foam core;

b) at least one layer of cover fabric laminated around the central foam core;

c) a laminating adhesive securing the cover fabric to the central foam core; and d) a water resistant polymeric coating covering the laminated cover fabric and laminating adhesive;

wherein the laminating adhesive comprises a water-based emulsion resin having a specific gravity of less than 2.0 g/m$^3$ selected from the group consisting of polyurethane-urea or methacrylic-acrylic copolymers or a mixture thereof.

27. The method of claim 25 wherein the laminating adhesive is selected from the group consisting of a water-based polyurethane-urea emulsion and a water-based methacrylic acid based polymer or a mixture thereof.

* * * * *